United States Patent [19]

Back

[11] Patent Number: 4,971,162

[45] Date of Patent: Nov. 20, 1990

[54] CONTINUOUS DRILL FEED APPARATUS

[75] Inventor: Carl F. Back, Fort Myers, Fla.

[73] Assignee: Carl F. Back, Fort Myers, Fla.

[21] Appl. No.: 451,929

[22] Filed: Dec. 18, 1989

[51] Int. Cl.[5] ..... E21B 4/20

[52] U.S. Cl. ..... 175/103; 175/104; 175/107; 175/122; 175/162

[58] Field of Search ..... 175/122, 92, 104, 105, 175/107, 162, 202, 203, 220, 26, 27, 103; 173/147

[56] References Cited

U.S. PATENT DOCUMENTS

| | | | |
|---|---|---|---|
| 3,150,723 | 9/1964 | Hale | 173/147 X |
| 3,692,123 | 9/1972 | Gyongyosi | 173/147 |
| 3,773,121 | 11/1973 | Ikeda | 175/104 X |
| 3,872,932 | 3/1975 | Gosselin | 175/26 X |
| 4,105,081 | 8/1978 | Perrand | 175/122 |

FOREIGN PATENT DOCUMENTS

| | | | |
|---|---|---|---|
| 1559734 | 2/1969 | France | 175/203 |

*Primary Examiner*—Hoang C. Dang

*Attorney, Agent, or Firm*—J. R. Bell; G. B. Foster

[57] ABSTRACT

A continuous feed system for a drill comprising a down-hole drill assembly having a support end and a drilling bit. Rotation is imported to the down-hole drill assembly between the support end and the drilling bit, which results in a torque being applied to the support end. A vertically disposed support chain has two ends, one end of the chain is connected to the support end. The chain resists the torque with limited torsional flexibility. A drive interacts with the chain at a point between the two ends for positively providing axial extension of a length of the chain.

14 Claims, 6 Drawing Sheets

CONTINUOUS DRILL FEED APPARATUS

BACKGROUND OF THE INVENTION

This invention relates generally to drill feed mechanisms, and more particularly to drill rigs in which the drill bit is supported and positioned utilizing a chain.

Presently, drilling involves intermittent feed arrangements. In these systems, a length of drill pipe is connected between the top drive and the drill bit. As soon as the drill has drilled for the maximum stroke of the drill rig, then the top drive is disconnected from the drill pipe, and a new length of drill pipe is inserted between the top drive and the old drill pipe section. Whenever is is desired to raise the drill bit, then the reverse operation must be performed.

This operation is extremely labor intensive and monotonous since an operator is required to couple or uncouple each drill pipe section. Considering the depth drilled to in most circumstances, and the number of times it is required to raise and lower the drill bit or core member (as is common in core sampling), it is easy to understand how a considerable amount of drilling and labor time could be saved in most drilling operations.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

In one aspect of the present invention, this is accomplished by providing a continuous feed system for a drill comprising a down-hole drill assembly having a support end and a drilling bit. Rotation is imported to the downhole drill assembly between the support end and the drilling bit, which results in a torque being applied to the support end. A vertically disposed support chain has two ends, one end of the chain is connected to the support end. The chain resists the torque with limited torsional flexibility. A drive interacts with the chain at a point between the two ends for positively providing axial extension of a length of the chain

DETAILED DESCRIPTION

Figure 1:
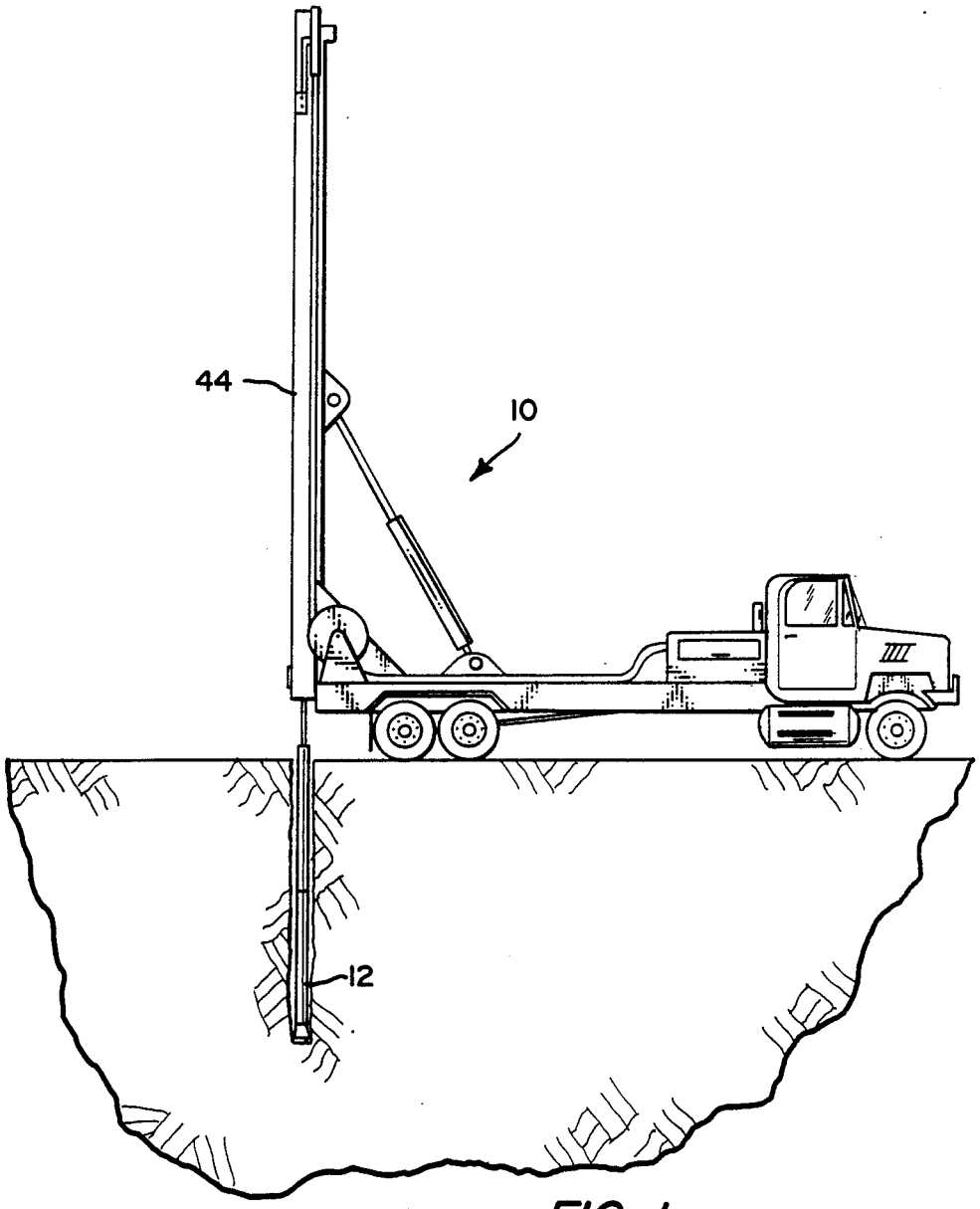
FIG. 1 illustrates a truck carrying one embodiment of the continuous drill feed apparatus of the instant invention.
Figure 2:
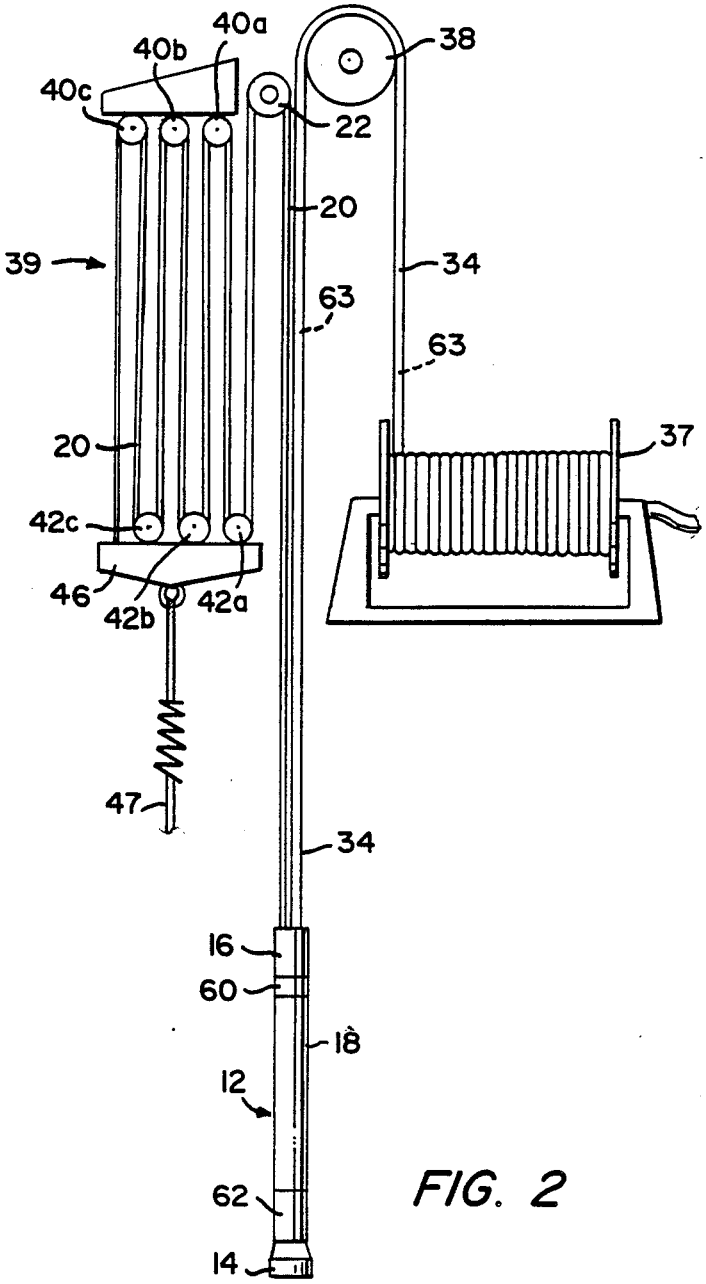
FIG. 2 illustrates a schematic of one embodiment of the continuous drill feed apparatus of the instant invention.
Figure 3:
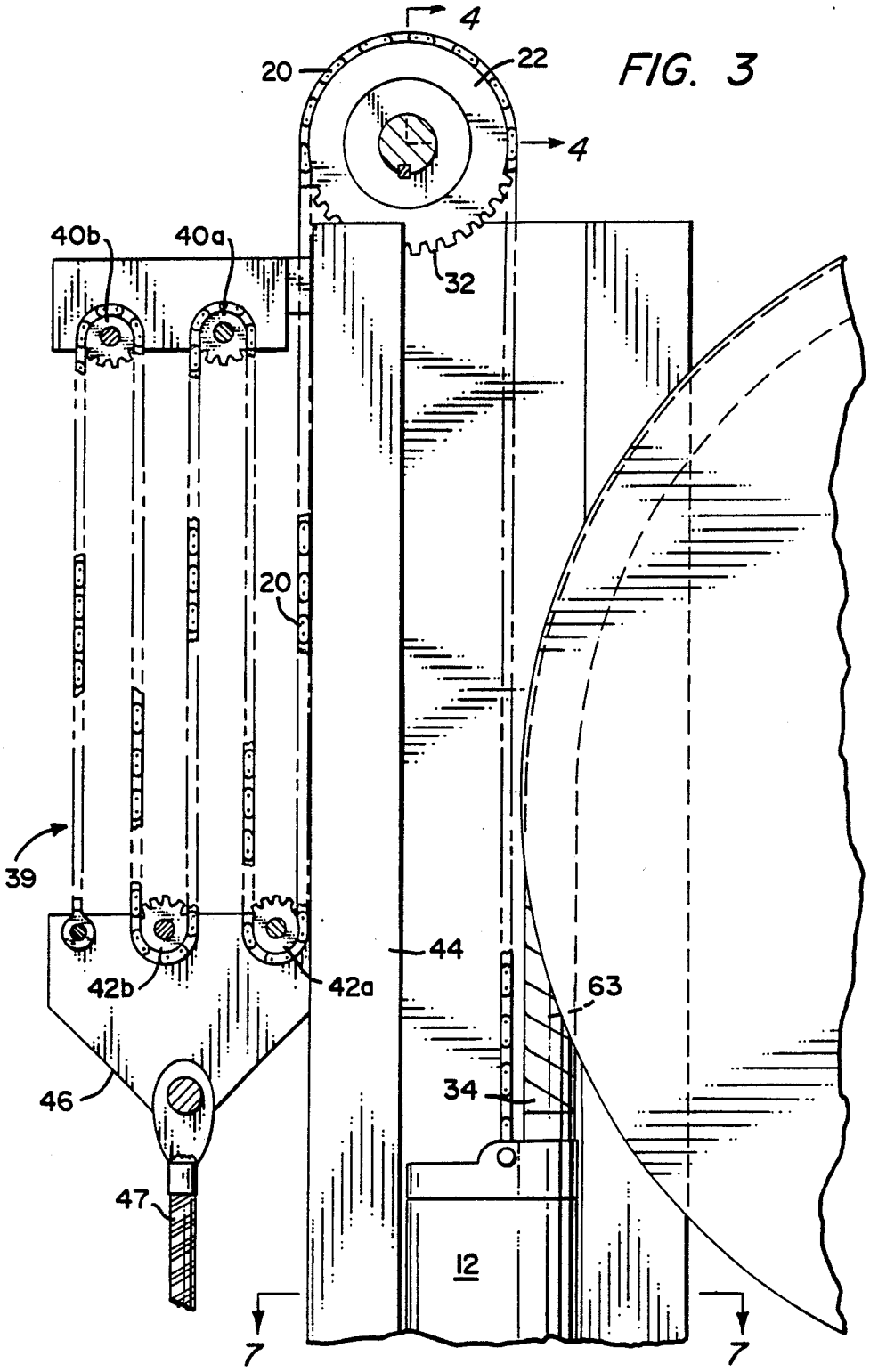
FIG. 3 illustrates a front view of one embodiment of the continuous drill feed of the instant invention.
Figure 4:
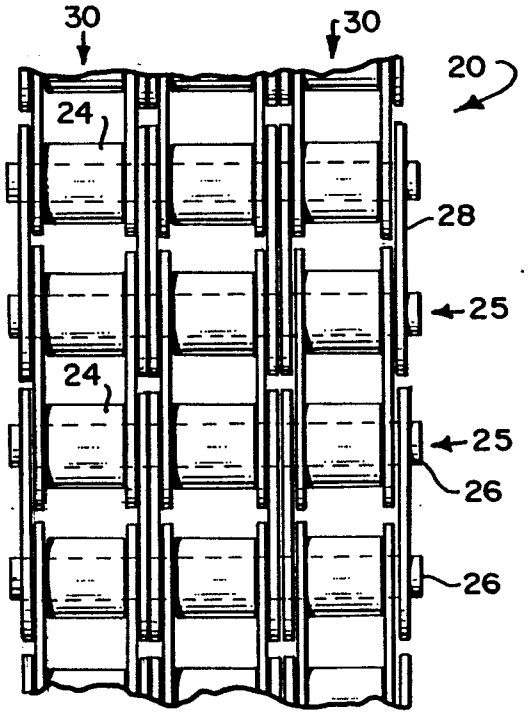
FIG. 4 is a front view of one embodiment of a chain of the instant invention.
Figure 5:
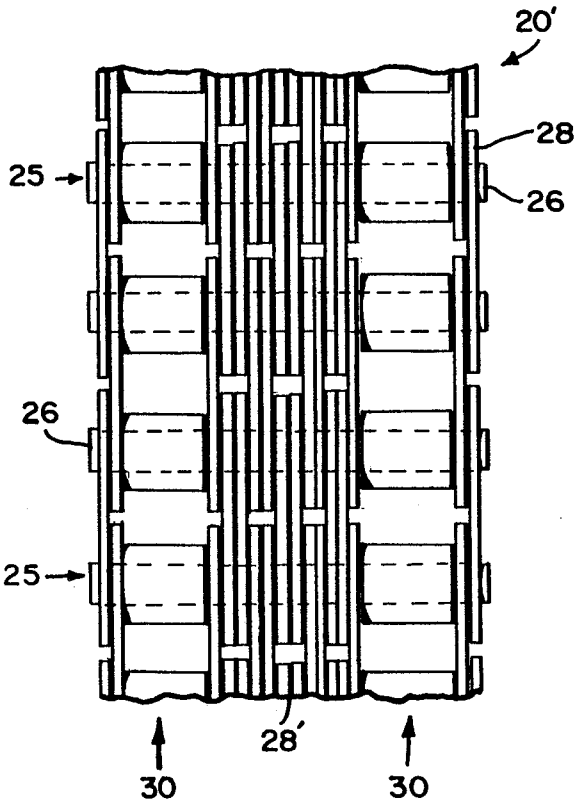
FIG. 5 a front view illustrating a different embodiment of the drive chain of the instant invention from that shown in FIG. 4.
Figure 6:
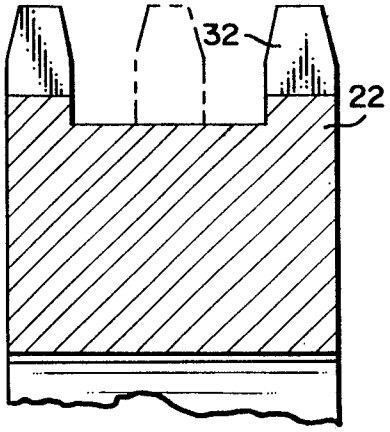
FIG. 6 illustrates a cross sectional view of the drive sprocket as taken through sectional lines 4—4 of FIG. 3.
Figure 7:
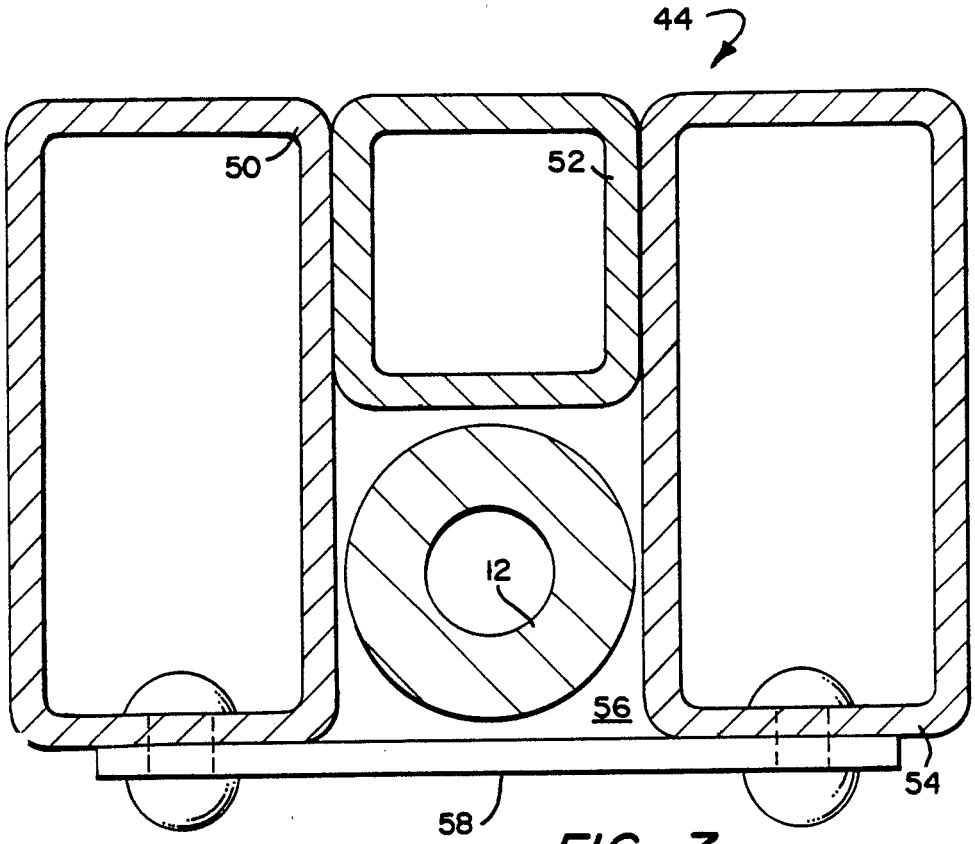
FIG. 7 illustrates a top sectional view of the support member as taken through sectional lines 7—7 of FIG. 3.
Figure 8:
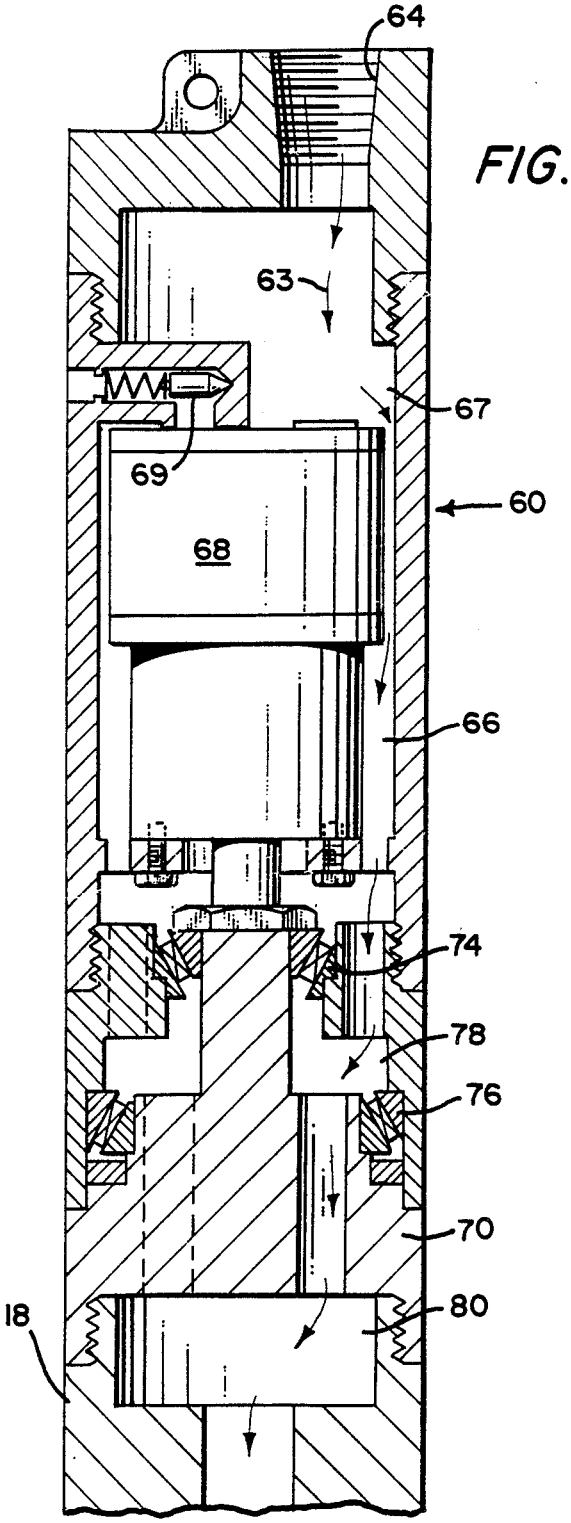
FIG. 8 illustrates a frontal cross sectional view of one embodiment of the rotation imparting member of the instant invention.

The instant invention pertains to a continuous drill feed system 10. A drill member 12 includes a drilling bit 14 and a support end 16. A drill collar 18 is included to provide weight and stabilization to the drill member 12 to assist in the drilling operation. The collar will be of a sufficient length as to ensure the drill member 12 remains straight during drilling. In normal drilling operations the drill 12 will weigh as much as 4,000 pounds to provide the drilling force. The weight and configuration of the drill collar 18 can be modified depending upon the type of drilling which the drill member 12 is performing.

A chain 20 is connected to the support end 16 of the drill 12, to control the rate of drilling, upward and downward motion, and pull back exerted on the drill. The chain provides torsional resistance to any reactive forces caused by the drill 12. While the chain 20 may undergo some torsional bending along the entire length, after the limit of this bending is reached, the chain will undergo very little further bending.

The motion of the chain is controlled by a drive sprocket 22. The angular rotation of the drive sprocket 22 precisely controls the depth of the drill. A plurality of rollers 24 are connected across the width of the chain. A single pin 26 connect all the rollers in a single row 25 of the chain 20. Links 28 connect the ends of the rollers of subsequent rows 25.

A modified chain is shown at 20'. A plurality of links 28' are included between each roller in two outer roller columns 30. The greater number of links provide an increased chain strength, as well as an enhanced torsional resistance. The gear teeth 32 on the drive sprocket 22 have to be modified to the specific roller configuration. Other similar chain-link configurations are within the anticipated scope of the instant invention.

A fluid hose 34, which provides fluid to the drill member 12, extends up the drill derrick 44 parallel to the chain 20. The hose passes over a hose roller 38, and is stored in a hose storage 37. The hose storage 37 may be a biased sheave, where the biasing force is set as to not influence the normal extension of the drill as previously described.

A chain storage 39 stores those portions of chain 20 not between the drive sprocket 22 and the drill member 12. The chain storage includes a plurality of pulleys combined in two or more sets. The first set of pulleys **40*a*, 40*b*, 40*c* are fixedly supported by a support member 44 which supports the drive sprocket 22. The second set of sprockets 42*a*, 42*b*, 42*c* are mounted on a sliding member 46. A tension member 47 provides tension between the two sets of pulleys 40 and 42** to keep the chain taut between the pulleys. If a greater length of chain is needed for the drilling process, more pulleys can be added.

Any increase of chain length between the drive sprocket 22 and the drill member 12 causes a corresponding decrease of chain contained within the chain storage 39. The sliding member 46 moves toward the first set of pulleys **40*a,b,c*** to let out a required amount of chain. If a greater length of chain is needed for the drilling process, more pulleys can be added to take up the longer chain.

The support member 44 completely surrounds the drill member 12 when the drill member is in a retracted position, such as occurs during initial drilling or transportation of the support member 44. The support member comprises a plurality of parallel, axially disposed, members 50, 52, and 54 which form three sides of an axially extending recess 56 which contains the drill. On the fourth side of the recess 56 are fastened a plurality of strips 58. The recess completely contain the drill member 12 such that when the support member is angled, no damage will result to the drill member.

The drill member comprises a plurality of portions. Initially, there is the support end 16 which is attached to the chain 20. A rotation imparting portion 60 causes the drill collar 18, a down the hole hammer 62 and the drilling bit 14 to rotate with respect to the support end 16. The down the hole hammer 62 is attached to the end of the drill collar 18. The hammer bit 14 is actuated by the hammer 62, and provides the drilling action for the drill member 12.

A fluid flow 63 from the fluid hose 34 passes through inlet 64. This fluid flow 63 divides between channel 66 and fluid motor 68. Note that motor 68 could be an air or hydraulically operated motor. A pressure regulating valve 69 may be used if the pressure within the chamber 67 exceeds that desired to operate the fluid motor. The valve 69 minimizes the pressure differential across the fluid motor 68, thereby limiting the flow through the fluid motor 68.

An electrically operated motor could also be used in place of the fluid motor 68 obviating the need for the fluid supply to the motor 68. If motor 68 is electrically operated, then the control cables for the motor would have to extend down the hole parallel to the chain 20.

The fluid flow through the fluid motor 68 causes rotation of the fluid motor 68, which rotates the drill collar 18 through connecting member 70. Bearings 74 and 76 support the connecting member 70. If a pressure in the fluid flow 63 is higher than is desired to operate the fluid motor 68, then a rotation control valve 69 may be applied to lower the flow applied to the fluid motor 68.

The fluid flow 63 which continued through the channel 66 continues through ducts 78 and 80. This flow powers hammer 62, as is well known in the prior art, and removes chips left by the drilling action of the hammer bit 14.

While this invention has been illustrated and described in accordance with a preferred embodiment, it is recognized that variations and changes may be made therein without departing from the invention as set forth in the claims.

What is claimed is:

1. A continuous feed system for a drill comprising:

a down-hole drill assembly having a support end and a drilling bit;

means associated with said down-hole drill assembly for providing rotation between the support end and the drilling bit, resulting in a torque being applied to the support end;

a vertically disposed support chain, having two ends, one end connected to the support end; the chain resisting the torque with limited torsional flexibility; and drive means interacting with the chain at a point between the two ends for positively providing axial extension of a length of the chain.

2. The system as defined in claim 1, further comprising:

storage means for storing and displacing portions of the chain which are not disposed between the drill and the drive means.

3. The system as defined in claim 2, wherein the storage means comprises opposed pulleys with the chain interspaced between the opposed pulleys.

4. The system as defined in claim 3, wherein the chain is tensioned by the opposed pulleys.

5. The system as defined in claim 1, wherein the drive means is a sprocket wheel.

6. The system as defined in claim 1, further comprising: a support member for supporting the drive means.

7. The system as defined in claim 6, wherein the support member provides radial support for the drill when the drill is in a stored position.

8. The system as defined in claim 7, wherein the support member comprises two parallel members, and two lateral members connecting lateral sides of the parallel members.

9. The system as defined in claim 1, wherein the chain comprises an axially extending plurality of parallel links attached by pins.

10. The system as defined in claim 1, wherein the means for providing rotation comprises an air motor.

11. The system as defined in claim 1, wherein the means for providing rotation comprises a hydraulic motor.

12. The system as defined in claim 1, wherein the means for providing rotation comprises an electric motor.

13. A continuous feed system for a drill comprising:

a down-hole drill assembly having a support end and a drilling bit;

a vertically disposed chain having two ends, one end of which is continuously extendible, the chain having limited torsional flexibility; the one end of the chain being connected to the support end;

means associated with said down-hole drill assembly for providing rotation between the support end and the drilling bit; and drive means interacting with the chain at a point between the two ends for positively providing axial extension of the chain member by operation of the drive means in a single direction.

14. A continuous feed system for a drill comprising:

a vertically disposed chain having a first end and a second end;

a down-hole drill assembly, having a support end and a drilling bit wherein the support end is attached to the first end of the chain;

means associated with said down-hole drill assembly for providing rotation between the support end and the drilling bit;

drive means, operable in a single direction to interact with the chain at a point between the two ends for positively providing axial extension of a portion of the chain between the drive member and the drill; and storage means for storing sections of the chain, which are not disposed between the drill assembly and the drive means, the storage means comprising sets of opposed pulleys with the chain interspaced between said sets of opposed pulleys.

* * * * *